United States Patent [19]

Welch et al.

[11] Patent Number: 4,696,654

[45] Date of Patent: Sep. 29, 1987

[54] AMMUNITION BELT ADVANCING ATTACHMENT FOR TOY FIGURES

[75] Inventors: Bennie R. Welch, Chicago; Russell G. Rasmussen, Skokie; Harry Disko, South Barrington, all of Ill.

[73] Assignee: Marvin Glass & Associates, Chicago, Ill.

[21] Appl. No.: 827,246

[22] Filed: Feb. 6, 1986

[51] Int. Cl.[4] ..... A63H 5/04

[52] U.S. Cl. ..... 446/268; 446/405; 446/473

[58] Field of Search ..... 446/303, 405, 406, 404, 446/420, 473, 418, 397, 408, 401, 268

[56] References Cited

U.S. PATENT DOCUMENTS

| | | | |
|---|---|---|---|
| 2,405,341 | 8/1946 | Binks | 446/406 |
| 3,015,186 | 1/1962 | Cook | 446/406 |
| 3,570,176 | 3/1971 | Palmer | 446/406 |
| 4,626,222 | 12/1986 | Sweet | 446/268 |

*Primary Examiner*—Mickey Yu

*Attorney, Agent, or Firm*—John S. Pacocha

[57] ABSTRACT

An attachment for a toy figure includes a simulated automatic firing weapon and a flexible belt with spaced apart simulated ammunition. The belt is movable through a backpack attachable to the figure by manual rotation of an exposed portion of a gear wheel carried by the backpack with the gear wheel teeth engaging the simulated ammunition. Sounds simulating firing of the weapon are produced by a ratchet, coaxial with the gear wheel, engaging a reed.

18 Claims, 8 Drawing Figures

10
11
25
60
15
12
13
54
51
8
38
56
32
36
34
35
16
29
23
4
20
17
27

10
11
50
12
27
14
29
13
82
80
32
16
34
17

5
6
63
27
72
74
66
23
7
65
76
41
29
78
77
66
70

68
41
29
74
65
66
66
72
27
70

63
43
29
48
65
66
68
54
44
60
56
62
27

63
60
29
65
74
76
68
72
66
78
77
41
62

20
52
27
50
51
43
58
46
54
23
52
41
56
25
54
48
46
58
56

38
36
27
21

AMMUNITION BELT ADVANCING ATTACHMENT FOR TOY FIGURES

BACKGROUND OF THE INVENTION

1. Field of the Invention

This invention relates generally to toy figures and more particularly to a weapon attachment for toy figures.

2. Background Art

Weapon attachments or features for toy action figures are old in the art. For example, U.S. Pat. No. 3,452,472 discloses a pistol raising figure while the toy figure of U.S. Pat. No. 4,182,075 has a pistol that actually fires a cap. There remains, however, a need for additional toy figures or attachments for toy figures, that can simulate the firing of a weapon.

SUMMARY OF THE INVENTION

The present invention is concerned with providing an attachment for a toy figure that can simulate the firing of an automatic weapon such as a machine gun. This and other objects and advantages of the invention are achieved by a weapon attachable to a toy figure in a firing position with a slot extending through the weapon. A flexible belt having simulated ammunition on one side is movable through the slot by a remotely mounted gear wheel. In addition to moving the simulated ammunition belt through the weapon, rotation of the gear wheel rotates a ratchet wheel into engagement with a reed to produce a sound simulating the firing of the weapon. The gear wheel and sound mechanism are carried in a backpack that is removably attachable to the toy figure.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
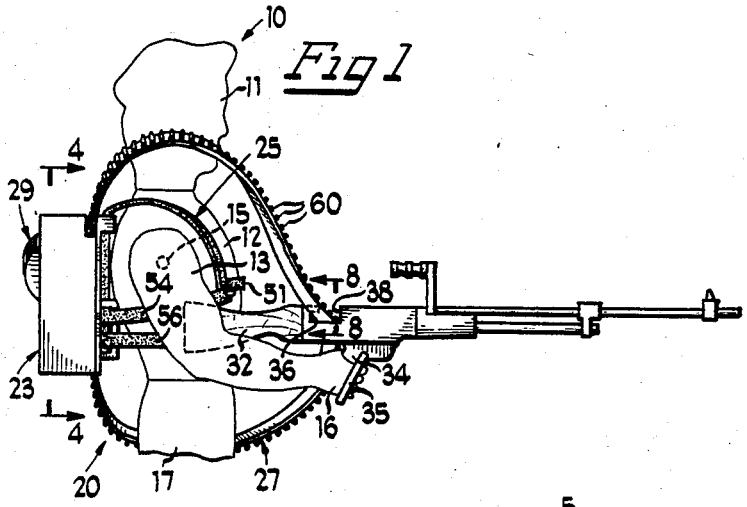
FIG. 1 is a side elevational view of an embodiment of the present invention.
Figure 2:
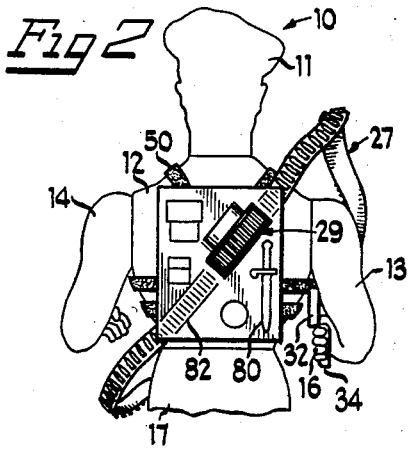
FIG. 2 is a rear elevational view.

Referring now to the drawings in which like parts are designated by like reference numerals throughout the several views, FIG. 1 shows a toy FIG. 10 having a head 11 atop a torso 12. A right arm 13 and a left arm 14 are each mounted on torso 12 for pivotal movement about an axis 15 in any one of a number of ways conventional in the toy figure art. Right arm 13 has a partially closed, or grasping hand 16. Below torso 12 is a lower trunk 17 to which legs may be fixedly, or pivotally, mounted.

An attachment 20 includes a weapon 21 styled to simulate a machine gun or other automatic firing gun attachable to hand 16. The attachment also includes a backpack 23 attachable to torso 12 by a harness 25 and a flexible, simulated ammunition belt 27 that is movable between weapon 21 and backpack 23 by means of gear wheel 29 carried by the backpack.

Machine gun 21 includes a rearward stock 32 that is inserted generally between the upper part of arm 13 and torso 12. Forward of the stock is a handle 34 to which a generally "C" shaped guard 35 is attached. Handle 34 fits within the grasping hand 16 of the figure with the fingers of the hand inserted between the guard 35 and the handle 34. Disposed above, and rearwardly of, handle 34 is a rectangular, ammunition belt receiving slot 36 extending through weapon 21 from one side to the other. The top of the slot has an opening 38 toward the front of the weapon.

Attachable to the torso of the figure is a backpack 23 that is formed of a relatively rigid plastic, generally in the shape of a rectangular box 41. The side of box 41 that will be adjacent the figure is formed with an upper, generally vertically extending slit 43. There are also a pair of generally horizontally extending aligned channels 44 adjacent each lower, lateral edge. Secured to the figure facing side of the backpack by screws 46, suitable adhesive, or other fasteners, is a principal portion 48 of harness 25.

The harness is made of a relatively flexible plastic such as vinyl. Extending upwardly through slit 43 is a generally hexagonal shoulder-chest strap 50 including a generally horizontally disposed portion 51 having an aperture 52 adjacent each corner. Out of each of the lower, lateral channels 44, an upper strap 54 and a lower strap 56 extend. Adjacent the end of each of the upper straps is a projection 58 that is receivable in one of the apertures 52. Near the end of one of the straps 56 there is a similar projection 58 which is received in an aperture 52 adjacent the end of the other strap 56.

Backpack 23 is attached to FIG. 10 by bending the shoulder-chest strap 50 with the hexagonal opening accommodating the head of the figure and securing strap 50 about the torso with straps 54. The ends of straps 56 are then fastened to each other about the abdomen of the figure to furhter secure the backpack.

Ammunition belt 27, like harness 25, is made of a relatively flexible plastic such as vinyl. The belt is formed in a closed loop with a generally plain, smooth inner surface. On the outside surface, the belt has evenly spaced apart ridges in the form of bullets or cartridges 60. Accordingly, belt 27 effectively forms a flexible, closed loop rack. A portion of belt 27 is trapped within box 41 with the belt extending at a diagonal through a lower corner slot 62 and an upper corner slot 63.

Slot 36 is long enough to accommodate the width of belt 27 and high enough to accommodate the thickness of the belt in its normal, unstretched condition. Opening 38, at the top front of the slot, is shorter than the width of belt 27 but longer than the thickness of the belt. Accordingly, to insert belt 27 into the slot, the thickness of the belt is first inserted through the smaller top opening. The belt is then rotated approximately ninety degrees so that the width of the belt is generally parallel to the length of machine gun 21. Stretching the belt to reduce the width and thickness facilitates insertion of the belt through opening 38.

Gear wheel 29 is mounted for rotation about an axle 65 that is journaled between blocks 66 within box 41.

Figure 4:
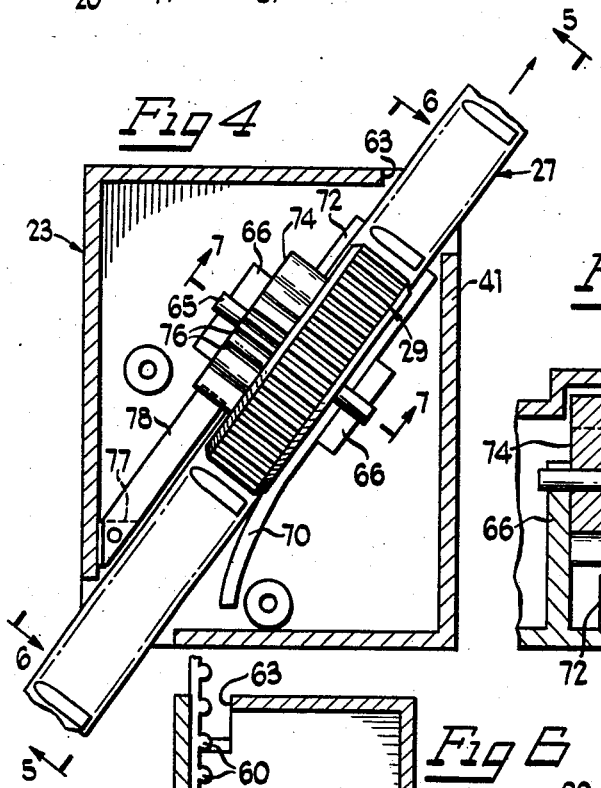
FIG. 4 is an enlarged, sectional view taken generally along line 4—4 of FIG. 1.
Figure 5:
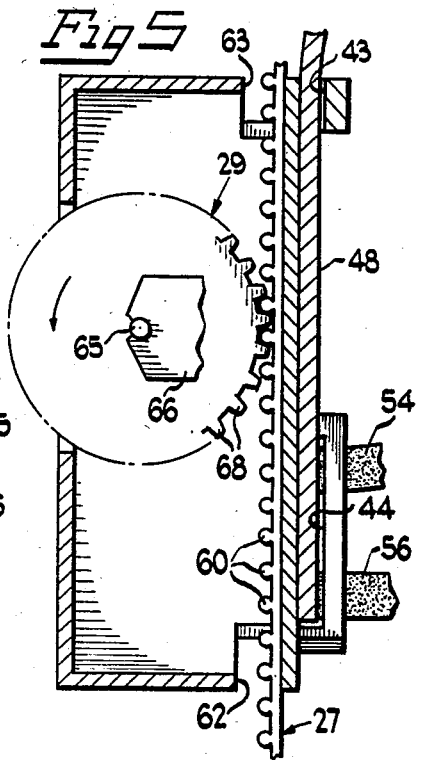
FIG. 5 is a sectional view taken generally along line 5—5 of FIG. 4.

Around the periphery of gear wheel 29 are teeth 68 that mesh with cartridges 60 on belt 27. The width of the wheel is substantially the same as the width of the belt. Thus, as is best shown in FIGS. 4 and 5, rotation of wheel 29 in a counterclockwise direction will move belt 27 into backpack 23 through lower corner slot 62 and out of the backpack through the diagonally opposed upper corner slot 63. A portion of gear wheel 29 extends out beyond backpack 23 for manual turning by a thumb or finger of a child.

Figure 7:
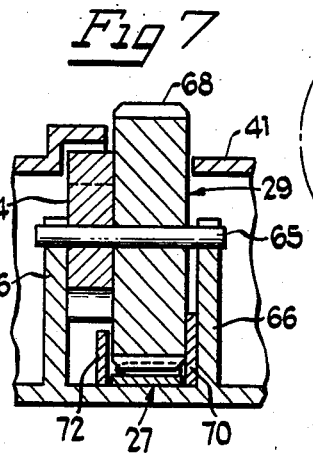
FIG. 7 is a sectional view taken generally along line 7—7 of FIG. 4.

Within the backpack there is a guide rail 70 on one side of wheel 29. Another guide rail 72 is positioned on the other side of the wheel. As is best illustrated in FIG. 7, the spacing between rails 70 and 72 is close to, but slightly greater than the width of belt 27. Accordingly, guide rails 70 and 72 properly position belt 27 beneath wheel 29 for engagement of gear teeth 68 on the wheel with the cartridges 60 on the belt.

Figure 6:
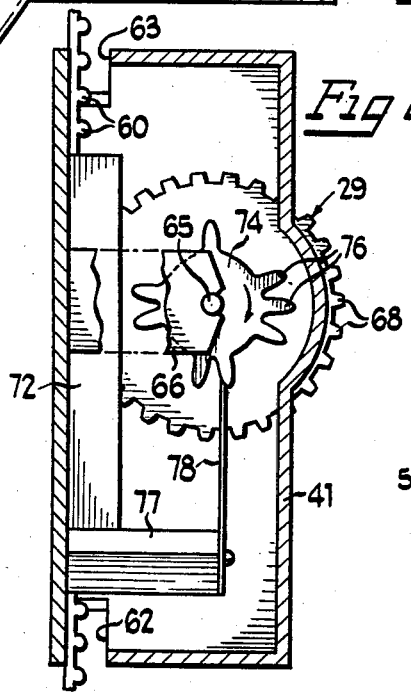
FIG. 6 is a sectional view taken generally along line 6—6 of FIG. 4.
Figure 3:
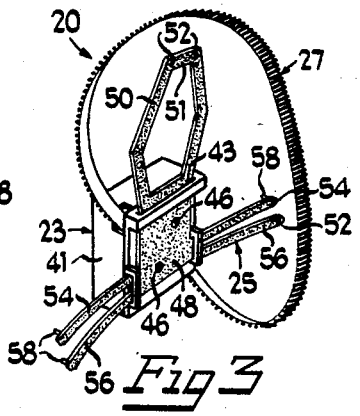
FIG. 3 is a perspective view of the attachment removed from the figure.
Figure 8:
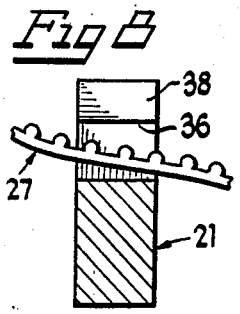
FIG. 8 is an enlarged, sectional view taken generally along line 8—8 of FIG. 1.

Coaxially mounted with gear wheel 29 is a ratchet wheel 74 having a number of irregularly spaced apart teeth 76. Mounted on a post 77 within box 41 is a reed 78 that is engaged by the teeth 76 of the ratchet wheel. Accordingly, as gear wheel 29 is rotated in a downward direction, or clockwise as shown in FIG. 6, teeth 76 depress and then release reed 78 producing a sound simulating the firing of machine gun 21.

On the outer side of backpack 23 are simulations of equipment, such as bayonet 80. In addition, a simulated band of cartridges 82 extends diagonally between the lower corner, where belt 27 enters the backpack, and the diagonally opposed upper corner, from which the belt emerges. The exposed peripheral portion of wheel 29 is aligned with band 82 further enhancing the simulation of a cartridge belt stretching across the back of the figure.

As gear wheel 29 is rotated downwardly by a child's thumb or finger, belt 27 moves through backpack 23 over the right shoulder of the figure and through slot 36 of machine gun 21 and then back again around the left side of the figure returning into backpack 23. At the same time the belt is being rotated to simulate the feeding of a belt of annumition into a machine gun, the teeth 76 of the ratchet wheel and the reed are creating sounds simulating the firing of the weapon.

While a particular embodiment of the present invention has been shown and described, changes and modifications will occur to those skilled in the art. It is intended in the appended claims to cover all such changes and modifications as fall within the true spirit and scope of the present invention.

What is claimed as new and desired to be secured by Letters Patent is:

1. An attachment for a toy figure comprising:
a weapon attachable to the figure in a firing position;
a slot extending through the weapon;
a flexible belt having simulated ammunition on one side of the belt;
the belt being received in the slot for movement through the slot;
means mountable on the figure and cooperating with the belt to move the belt through the weapon;
the moving means including a gear with teeth engaging the simulated ammunition; and
teeth on the gear generally diametrically opposite the teeth engaging the ammunition being engagable by part of a child's hand to rotate the gear and move the belt.

2. The attachment of claim 1 in which the moving means is carried by a backpack attachable to the toy figure.

3. The attachment of claim 2 in which the backpack is generally rectangular and the belt passes through the backpack on a diagonal.

4. The attachment of claim 2 in which the backpack is attachable to the toy figure by a flexible harness.

5. The attachment of claim 2 in which the backpack is removably attachable to the figure.

6. An attachment for a toy figure comprising:
a weapon attachable to the figure in a firing position;
a slot extending through the weapon;
a flexible belt having simulated ammunition on one side of the belt;
the belt being received in the slot for movement through the slot;
the slot being rectangular and one of the sides of the slot having an opening permitting insertion of the belt into the slot; and
means mountable on the figure and cooperating with the belt to move the belt through the weapon.

7. The attachment of claim 6 in which:
the belt is generally rectangular in cross section and has a predetermined width and thickness in a normal, unstretched, condition; and
the width is greater than the opening and the thickness is less than the opening.

8. The attachment of claim 6 in which the moving means is carried by a backpack attachable to the toy figure.

9. The attachment of claim 8 in which the backpack is generally rectangular and the belt passes through the backpack on a diagonal.

10. The attachment of claim 8 in which the backpack is attachable to the toy figure by a flexible harness.

11. The attachment of claim 8 in which the backpack is removably attachable to the figure.

12. The attachment of claim 10 in which the moving means includes a gear with teeth engaging the simulated ammunition.

13. The attachment of claim 12 in which teeth on the gear that are generally diametrically opposite the teeth engaging the ammunition are engagable by part of a child's hand to rotate the gear and move the belt.

14. An attachment for a toy figure comprising:
a weapon attachable to the figure in a firing position;
a slot extending through the weapon;
a flexible belt having simulated ammunition on one side of the belt;
the belt being received in the slot for movement through the slot;
means mountable on the figure and cooperating with the belt to move the belt through the weapon; and
the moving means being carried by a backpack attachable to the toy figure.

15. The attachment of claim 14 in which the backpack is generally rectangular and the belt passes through the backpack on a diagonal.

16. The attachment of claim 14 in which the backpack is attachable to the toy figure by a flexible harness.

17. The attachment of claim 14 in which the backpack is removably attachable to the figure.

18. The attachment of claim 12 in which:
the slot is rectangular and one of the sides of the slot has an opening permitting insertion of the belt into the slot;
the belt is generally rectangular in cross section and has a predetermined width and thickness in a normal, unstretched, condition; and
the width is greater than the opening and the thickness is less than the opening.

* * * * *